United States Patent [19]

Kohler

[11] Patent Number: 5,050,563

[45] Date of Patent: Sep. 24, 1991

[54] MIXTURE CONTROL SYSTEM FOR AN INTERNAL COMBUSTION ENGINE

[75] Inventor: Rolf Kohler, Schwieberdingen, Fed. Rep. of Germany

[73] Assignee: Robert Bosch GmbH, Stuttgart, Fed. Rep. of Germany

[21] Appl. No.: 563,627

[22] Filed: Aug. 7, 1990

[30] Foreign Application Priority Data

Aug. 8, 1989 [DE] Fed. Rep. of Germany ..... 3926096

[51] Int. Cl.[5] ..... F02D 41/12; F02D 41/14

[52] U.S. Cl. ..... 123/489; 123/493

[58] Field of Search ..... 123/325, 440, 489, 493

[56] References Cited

U.S. PATENT DOCUMENTS 4,311,123 1/1982 Glöckler et al. ..... 123/325

4,461,258 7/1984 Becker et al. ..... 123/440

*Primary Examiner*—Tony M. Argenbright

*Attorney, Agent, or Firm*—Walter Ottesen

[57] ABSTRACT

The invention relates to a mixture control system which provides the possibility of interrupting fuel during overrun operation. The mixture control system includes apparatus for controllably reducing fuel metering at the start of overrun operation and/or controllably resuming the metering of fuel after the end of overrun operation with the controllable reduction and/or resumption taking place via a corresponding control via the integrator component of the mixture control in dependence upon the composition of the exhaust gas. A very advantageous system with respect to complexity and computation time is provided by the cooperative relationship between lambda control and mixture control.

4 Claims, 2 Drawing Sheets

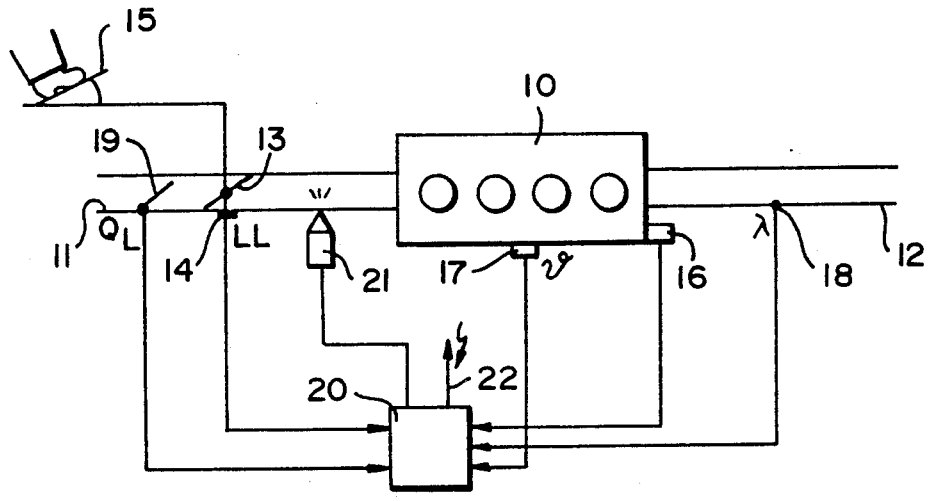
FIG. 1
FIG. 2a
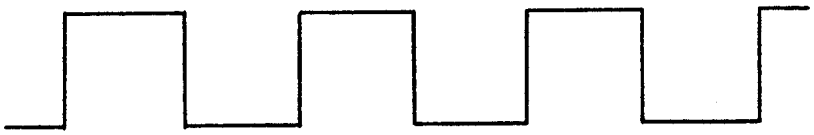
FIG. 2b
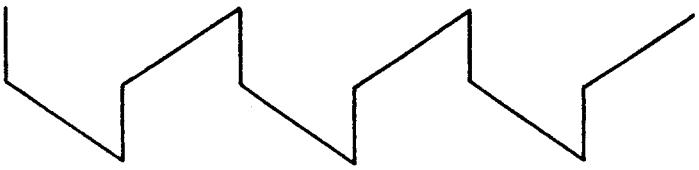
FIG. 3a
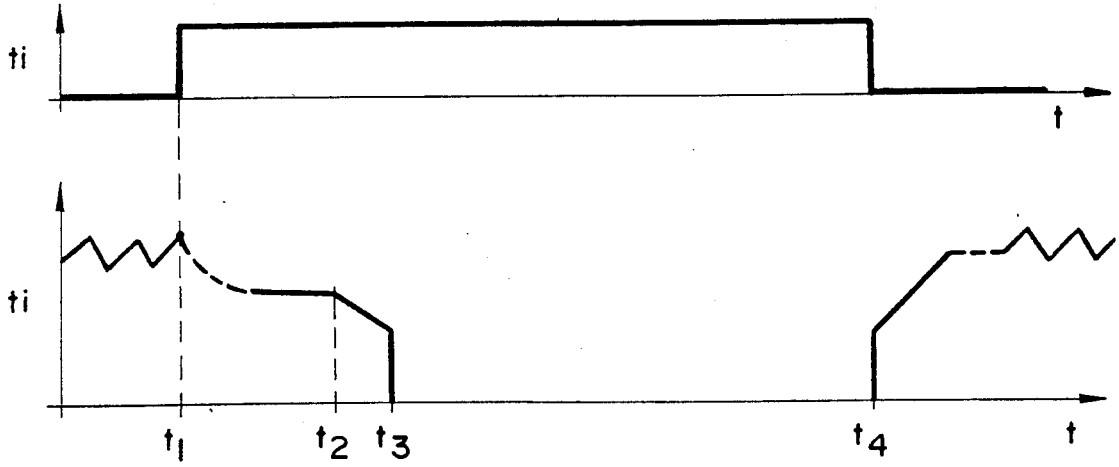
FIG. 3b

MIXTURE CONTROL SYSTEM FOR AN INTERNAL COMBUSTION ENGINE

FIELD OF THE INVENTION

The invention relates to a mixture control system for an internal combustion engine wherein fuel can be interrupted in overrun operation and means controllably reduce the fuel metered to the engine at the beginning of the overrun operation and/or controllably resume the metering of fuel at the end of the overrun operation.

BACKGROUND OF THE INVENTION

U.S. Pat. No. 4,311,123 relates to a method and arrangement for controlling the fuel metered to an internal combustion engine. FIG. 2 of this patent shows the control of the fuel metered to the engine at the beginning and after the end of the overrun operation. When the accelerator pedal returns to its zero position, then the throttle flap reaches its idle position which signalizes the start of an overrun operation when the rotational speed is above a predetermined threshold value. A certain time duration follows during which the metering of fuel is maintained and the fuel metered to the engine is thereafter reduced according to a predetermined function whereafter fuel metered to the engine is abruptly interrupted. The overrun operation can be ended by a renewed desire on the part of the driver for acceleration or by a drop in engine speed into the range of idle speed. After the end of the overrun operation and independently of the manner in which the overrun operation is ended, a jump-like increase in the fuel metering to a value first takes place at which an ignitable mixture is provided for which the torque resulting therefrom is however not too great. This is advantageous when viewed in the context of a smooth transition between overrun operation and normal driving operation. The rate at which fuel is metered is then brought to a normal value pursuant to a selectable function after the jump-like increase in the metering fuel rate.

The known mixture control system has been found to be advantageous with respect to the driving performance obtained therewith. The additional function generator required for the known system has, however, been shown to be unsuitable with respect to the series manufacture of these systems.

U.S. Pat. No. 4,461,258 discloses a lambda control system wherein the individual proportional and integral components for the lambda control are stored and these components can be read out of the memory in dependence upon operating characteristic variables and serve for the lambda control. Such lambda control systems are at the present time used wherever the oxygen content in the exhaust gas is monitored when it is desired to have an exhaust gas with the least amount of contaminants and from there to lean the mixture or enrich the mixture with the aid of a two-point control process. An essential component of this system is a controller having at least an integrating capability.

SUMMARY OF THE INVENTION

It is an object of the invention to provide a system for motor vehicles which is as optimal as possible with respect to function and complexity.

The mixture control system according to the invention affords the advantage that a surprisingly simple and elegant solution is provided which is relatively easy to prepare with respect to a program.

BRIEF DESCRIPTION OF THE DRAWINGS

The invention will now be described with reference to the drawings wherein:

FIG. 1 is an overview schematic showing the engine and the relationship thereof with the individually detected operational characteristic variables and the variables to be controlled;

Figure 4:
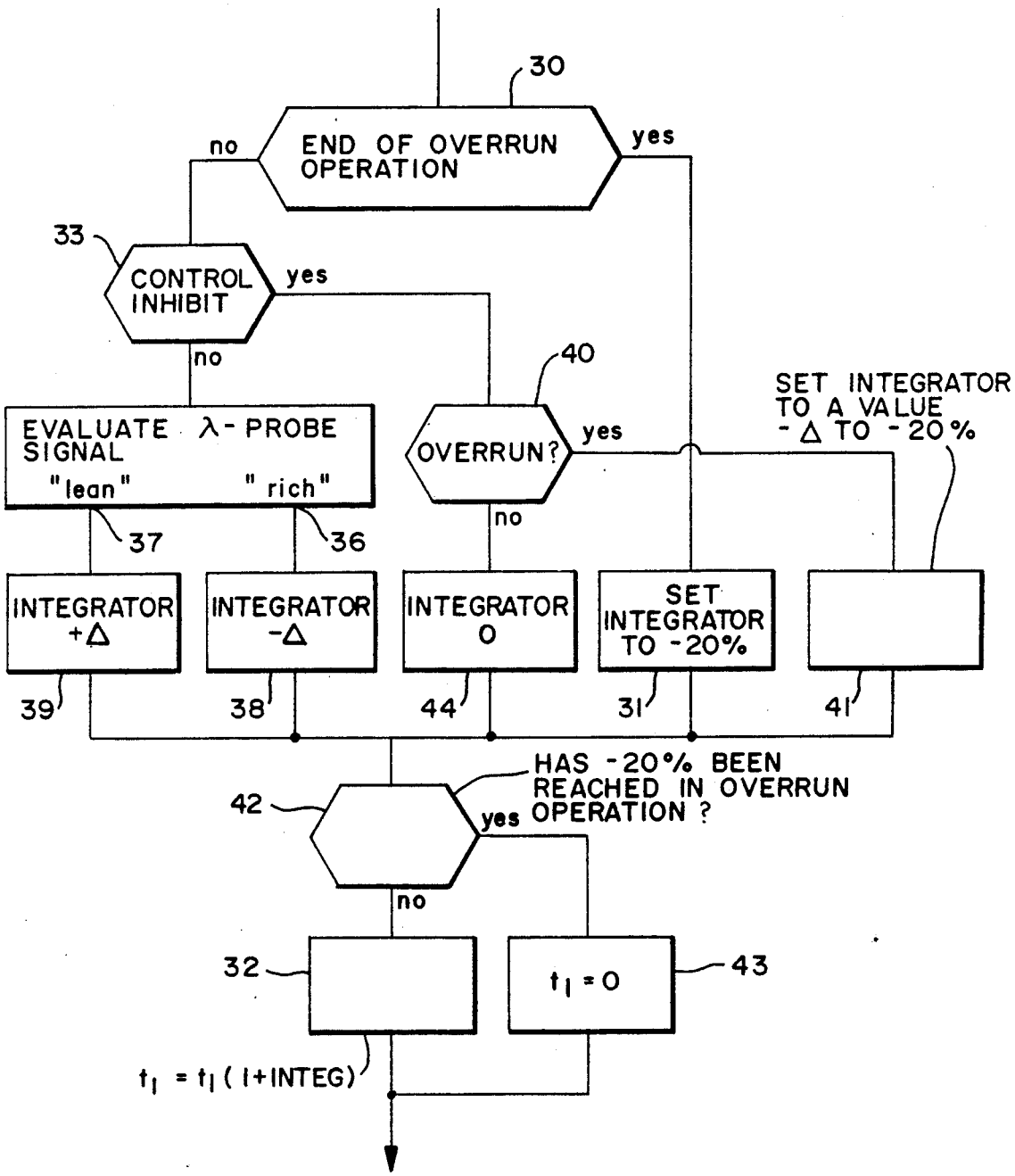

FIGS. *2a* and *2b* show the relationships present in a lambda control of the kind described in U.S. Pat. No. 4,461,258 with FIG. *2a* showing the idealized output signal of a probe disposed in the exhaust gas pipe and with FIG. *2b* showing the waveform of a lambda controller;

FIGS. *3a* and *3b* show the relationships present when fuel is metered in the course of the occurrence of overrun operation; and, FIG. 4 shows a flowchart showing the essential features of the mixture control system according to the invention.

DESCRIPTION OF THE PREFERRED EMBODIMENTS OF THE INVENTION

FIG. 1 provides an overview of an internal combustion engine in combination with the essential operating characteristic variables to be detected for controlling the metering of fuel to the engine as well as the ignition. The engine is identified by reference numeral 10 and an air intake pipe 11 leads thereto. An exhaust-gas pipe 12 conducts the combustion gases away from the engine. A throttle flap 13 is disposed in the air intake pipe 11 and a throttle flap switch 14 is associated therewith. The throttle flap itself is operatively connected to the accelerator pedal 15. A speed sensor 16 as well as a temperature sensor 17 are connected to the engine 10. An exhaust-gas probe 18 is disposed in the exhaust-gas pipe 12 and is usually configured as an oxygen probe or lambda probe. A flap-airflow sensor 19 is also arranged in the air intake pipe.

A control apparatus 20 processes the signals of the individual sensors and makes an injection signal available to an injection valve 21 as well as an ignition signal 22 to an ignition system (not shown).

The operation of such a control system for an internal combustion engine has been known for some time. The fuel metering via the injection valve 21 as well as the ignition control take place in dependence upon respective individually detected operating characteristic variables with the objective of obtaining the best possible efficiency of the engine as well as an exhaust gas which is as free as possible from contaminants.

FIGS. *2a* and *2b* show the operation of the so-called lambda control which is shown in FIG. 1 with the probe 18 disposed in the exhaust-gas pipe 12 which checks whether or not this exhaust gas contains an oxygen component. FIG. *2a* shows the idealized output signal of such a probe for which the individual signal flanks symbolize the respective transitions from a rich to a lean mixture and vice versa. The actual lambda controller forms the signal waveform shown in FIG. *2b* therefrom wherein a jump in the opposite direction is provided at the switching timepoints of the probe. This jump extends into an integral control performance until the occurrence of the next jump in the output signal of the exhaust-gas probe 18.

The point of the invention is to place the known lambda controller into use in a targeted manner in the control of fuel metering during the transition into the overrun operation and out of the overrun operation.

FIG. 3*a* shows an overrun signal as a function of time and FIG. 3*b* shows the magnitude of the fuel metering in the region of overrun operation.

At timepoint t1, the accelerator pedal is released at a relatively high engine speed and the idle contact on the throttle flap is actuated as a consequence thereof. The presence of an overrun operation is present as a consequence of this action for which the driver of the vehicle desires a reduction of the vehicle speed. Overrun operation is in principle always present when the instantaneous engine speed has a value which is above a speed value which is associated with an instantaneous throttle flap position. Accordingly, the term overrun operation is here used in a general form. A complete closure of the throttle flap is therefore not necessarily required.

FIG. 3*b* shows the relationships with reference to the fuel metering before, during and after overrun operation. The durations of the individual fuel metering pulses ti are shown as a function of time. The sawtooth waveform ahead of the timepoint t1 schematically represents the continuous enrichment and leaning of the mixture in combination with the lambda control. If overrun operation occurs, then the lambda control is switched off as a rule and a transfer to the control for fuel metering takes place. The air quantity drawn in by suction is reduced as a consequence of the closure of the throttle flap and the duration of the individual fuel metering pulses is simultaneously reduced as a consequence thereof so that a controlled fuel metering to a lower level occurs during the time duration between t1 and t2. After a delay time to the point t2 has run, the mixture is then reduced preferably by 10 to 20% pursuant to a specific function and the fuel metering is completely interrupted at the time point t3.

Overrun operation is ended at timepoint t4 with the consequence of a resumption of a lean mixture metering which is subsequently controlled upwardly pursuant to a specific function. A normal lambda control operation continues again thereafter.

The waveform shown in FIG. 3*b* is realized according to the invention in that the controller known from the state of the art is used with its integral component to provide a controlled reduction of the fuel metering during the time duration between t2 and t3 and again for resuming the fuel metering at the end of the overrun operation.

FIG. 4 shows a flowchart with reference to the portion of the mixture control system for the engine which is essential to the invention. In this context, an inquiry 30 is made in the context of a normal program run-through as to whether the end of the overrun operation is reached. If this is indeed the case, then the lambda integrator is set to a specific value such as −20% (block 31). A new injection time of the logic equation $t1 = t1 \times (1 + \text{Integ})$ is formed with this value in block 32. If the integrator value is, for example, −20%, then the new injection time is determined in block 32 simply with 80% of the fuel quantity normally made available.

If the inquiry in block 30 determines that the end of the overrun operation is not yet present, then an inquiry follows in block 33 pursuant to a control inhibit with respect to the lambda control. If no control inhibit is present (that is, a normal lambda control operation is present), an evaluation of the probe signal in the direction of enrich (output 36) or in the direction of lean (output 37) takes place in block 34. The corresponding integrator values are set in the following blocks 38 and 39. These integrator values determine the slope according to FIG. 2*b*. The individual proportional components are controlled parallel to the determination of the individual slope values. These proportional components are however not shown in the flow diagram of FIG. 4 so that a clear overview can be provided.

If a control inhibit is present, then an inquiry follows at 40 as to whether overrun operation is present. In the positive case, the integrator in block 41 is set to a value between −Δ to −20%. Thereafter, a determination is made by means of inquiry 42 as to whether the desired degree of leaning (for example 20%) has already been reached in the overrun operation and, if yes, the injection value is set to zero in block 43. Block 43 is parallel to block 32 for this purpose.

If overrun operation is not provided in correspondence to the inquiry 40, then the integrator is set to zero with a block 44 resulting in a pure control operation. The blocks 31, 38, 39, 41 and 44 are logically connected together at the output end and the inquiry 42 takes place ahead of block 32.

What is essential in FIG. 4 is the fact that the same integrator which serves the lambda control also is used to determine the fuel metering after the start and at the end of the overrun operation.

It is understood that the foregoing description is that of the preferred embodiments of the invention and that various changes and modifications may be made thereto without departing from the spirit and scope of the invention as defined in the appended claims.

What is claimed is:

1. A mixture control system for an internal combustion engine, the mixture control system comprising:

lambda control means for controlling the fuel mixture supplied to the engine in dependence upon the composition of the engine exhaust gas;

said lambda control means having at least an integral component having an integral action performance capability; and, said lambda control means further including ancillary control means for acting on said integral component to controllably reduce the fuel metered to the engine at the start of the overrun operation ($t_1$) and for a predetermined time interval ($t_1$–$t_3$) thereafter during the overrun operation and, at the end of the overrun operation ($t_4$), to then controllably increase the fuel metered to the engine.

2. The mixture control system of claim 1, wherein the control of the reduction and resumption of the fuel metering is performed in segments by said integral component.

3. The mixture control system of claim 2, wherein the mixture is leaned by approximately 10 to 20% toward the end of said time interval ($t_1$–$t_3$) and thereafter the fuel metering is interrupted.

4. The mixture control system of claim 2, wherein the resumption is first jump-like to a lean value whereafter a control takes place to a richer mixture.

* * * * *